United States Patent [19]

Nourmand

[11] Patent Number: 4,937,560

[45] Date of Patent: Jun. 26, 1990

[54] SECURITY SYSTEM WITH DOOR DEADBOLT INTERLOCK

[76] Inventor: Stephan S. Nourmand, 904 N. Whittier Dr., Beverly Hills, Calif. 90210

[21] Appl. No.: 231,287

[22] Filed: Aug. 11, 1988

[51] Int. Cl.[5] ..... E058 45/06; H01H 47/00

[52] U.S. Cl. ..... 340/542; 361/172

[58] Field of Search ..... 340/542–543, 340/528, 426, 430, 825.31–825.32; 361/172; 307/10.2; 180/287, 289; 70/DIG. 49, 432

[56] References Cited

U.S. PATENT DOCUMENTS

| | | | |
|---|---|---|---|
| 3,936,673 | 2/1976 | Kelly et al. | 340/426 X |
| 4,196,422 | 4/1980 | Swigert et al. | 340/542 |
| 4,225,008 | 9/1980 | Colell et al. | 180/287 |
| 4,370,644 | 1/1983 | Droz | 340/528 |
| 4,635,035 | 1/1987 | Ratzabi | 340/426 |
| 4,689,610 | 8/1987 | Dietrich | 340/528 X |

*Primary Examiner*—Joseph A. Orsino
*Assistant Examiner*—Thomas J. Mullen, Jr.
*Attorney, Agent, or Firm*—John J. Posta, Jr.

[57] ABSTRACT

A device for use with security systems for residential or commercial buildings is disclosed which prevents an entrance door to the building both from being locked without first activating the security system, and from being unlocked without first deactivating the security system. The system uses an electromechanical interlock to prevent a deadbolt from being moved from an unlocked position to a locked position until the security system is armed. The eletromechanical interlock also prevents the deadbolt from being moved from the locked position to the unlocked position until the security system is disarmed.

23 Claims, 2 Drawing Sheets

SECURITY SYSTEM WITH DOOR DEADBOLT INTERLOCK

BACKGROUND OF THE INVENTION

Field of the Invention

The present invention relates generally to security systems for residential or commercial buildings, and more particularly to an electrical or electronic security system which prevents an entrance door to the building both from being locked without first activating the security system, and from being unlocked without first deactivating the security system.

One of the seemingly inevitable consequences of our increasingly crowded urban society has been an ever-increasing crime rate, or at least the threat thereof. Breaking and entering and burglary have become increasingly common occurrences, affecting both residential property and commercial property. Accordingly, the sale and installation of various security systems, commonly known as burglar alarms, has become a thriving business as many property owners seek to discourage crime to property through the use of such systems.

The typical system for use to safeguard a building has five basic elements: a control unit, a power supply for powering the system, a main on/off switch, one or more sensors to detect illicit entry, and means for providing an alarm or other indication of the occurrence of unauthorized entry. The control units are electrical, or, more typically, electronic systems of considerable sophistication. Power supplies generally are connected to AC line voltage, with a DC battery backup. The main on/off switch is typically a numerical keypad, although in some cases key locks may be used. The sensors include devices to detect the opening of a door or window, pressure pads, and optical or sonic sensors. The alarm may be provided audibly, through the use of a horn or bell, or electronically to the police or to a security company to cause the police or security guards to promptly descend on the building to investigate the alarm.

There exist two major problems with alarm systems for use with buildings, and both are very basic problems. The first, and most serious, is the problem of remembering to activate the security system upon leaving the building. The second problem, also serious, is remembering to deactivate the system prior to entry into the building.

With regard to the first problem of remembering to arm the security system, it is almost inevitable that people will forget to activate the security system when leaving from time to time. The omission may occur accidentally through oversight, or it may occur deliberately, but in either event the all too frequently result is an illegal entry and property loss. It is accordingly a primary objective of the present invention to provide a system which will require the alarm system to be set without fail, each time the building is to be left by its inhabitants.

As might be expected, the art is not silent as to improvements and innovations encouraging the setting of the alarm system. Unfortunately, most such systems are intended for use with automobiles rather than with dwellings. Examples of such systems are illustrated in U.S. Pat. No. 3,936,673, to Kelly et al., in U.S. Pat. No. 4,225,008, to Colell et al., and in U.S. Pat. No. 4,635,035, to Ratzabi. All three of these systems use a combination lock and switch, with the car being locked or unlocked, and the alarm being simultaneously activated or deactivated with a key.

The Kelly et al. device teaches the basic concept, while the Colell et al. and Ratzabi devices go further and provide authorized keys which may perform both functions, while nonauthorized keys will merely lock or unlock the lock of the car, and not deactivate that alarm system. The basic problem with these systems is that a person who is adept at locks may gain entry to the vehicles, deactivating the alarm systems by picking the lock. While such systems are obviously better than no security system, they do not provide optimal security.

A similar system for use with buildings is disclosed in U.S. Pat. No. 4,370,644, to Droz. The Droz system has a switch operated by a sliding bolt in the door, and has the same problem as the other systems described above-namely that an intruder need only pick the lock to both gain entry and to disarm the security system. Today, most sophisticated security systems, both for automobiles and for dwellings, use numerical keyboards as the deactivation device (and also frequently as the activation device). As such, the security system may not be deactivated by merely picking the lock.

It is therefore an objective of the present invention to provide a security system which will not be capable of being deactivated by merely picking the entry lock. In addition, an improved system should also be set each time the building is left (at least for an extended period), or when the building is left in a locked condition. The improved system must not depend on being set by a person leaving the building. A number of automobile systems have an automatic setting feature initiated by removing the key from the ignition, but security systems for dwellings do not have such a feature. The automatic setting of the security system should not be initiated by merely locking the entry door, since entry doors of dwellings are commonly locked with the inhabitants inside.

The second major problem, namely of remembering to deactivate the security system, does not present the threat of property loss in the event of a failure to deactivate the system prior to entry. Rather, the problem presented is that of a false alarm occurring when someone forgets to deactivate the security system. The problem is annoying when forgetting to deactivate the system sets off a horn or bell, particularly at night when neighbors may be sleeping. It is minimal, however, since, the security system can usually be turned off quickly.

The problem is exacerbated when the alarm is provided to the police or to a private security agency, generally resulting in an armed patrol descending on the building. This may present a dangerous situation to the authorized person, who may be mistaken for a criminal. It is also expensive, since both the police and security agencies may charge for false alarms.

One of the solutions the art has provided to this problem is the provision of a low level alarm within the building for a short time to remind the person forgetting to deactivate the security system that the system is still on. This is at best a pseudo-solution to the problem, since it will also act as a warning to an illicit intruder. It is accordingly a primary objective of the present invention to provide a security system which will be deactivated prior to entry of the building.

Such a system must not be deactivated merely by unlocking the entry door, but rather must possess an independent deactivation mechanism. In addition, the system must absolutely prevent the building from being entered prior to the security system being deactivated. The system which is a solution to the problems enumerated above must also possess several other attributes. It must be both effective and easy to use, and is preferably of an unsophisticated design both to make it economic of manufacture and highly reliable. It must also eliminate all of the above problems and achieve all of the desired advantages and objectives without incurring any relative disadvantage.

SUMMARY OF THE INVENTION

The disadvantages and limitations of the background art discussed above are overcome by the present invention. With this invention, a electromechanical interlock system is used to prevent an entry door from being locked with a deadbolt prior to activation of a security system. In addition, the electromechanical interlock system is also used to prevent the deadbolt from unlocking the entry door prior to deactivation of a security system. By requiring these two interlock mechanisms, all of the objectives and advantages of the present invention may be realized.

A conventional security system is used, with two electrical outputs from the security system being used to operate an interlocking mechanism. These two electrical outputs are an activate line, which has a voltage on it when the security system is armed (as by a numerical pad), and a disarm line, which has a voltage on it when the security system is disarmed. The two electrical outputs are used in the preferred embodiment to operate two solenoids, which in turn operate two longitudinally moveable spring-loaded solenoid shafts.

The deadbolt mechanism of the preferred embodiment has two notches located in the sliding bolt used to lock the entry door. The sliding bolt has two positions, namely an unlocked position and a locked position. When the sliding bolt is in the unlocked position, the first solenoid shaft is spring biased into the first notch in the sliding bolt. Only when the activate line energizes the first solenoid coil is the first solenoid shaft drawn out of the first notch, allowing the sliding bolt to be moved to the locked position.

With the sliding bolt in the locked position, the second solenoid shaft is spring biased into the second notch in the sliding bolt. Only when the deactivate line energizes the second solenoid coil is the second solenoid shaft drawn out of the second notch, allowing the sliding bolt to be moved to the unlocked position. This device thus accomplishes the objectives of the present invention, preventing the entrance door from being locked without first activating the security system, and from being unlocked without first deactivating the security system.

In a first alternate embodiment, a single notch is used on the sliding bolt, with the first solenoid shaft being spring biased into the notch when the sliding bolt is in the unlocked position. When the sliding bolt is moved to the locked position, the second solenoid shaft is spring biased into the notch.

In a second alternate embodiment, a single sliding mechanical interlock element replaces the first and second sliding solenoid shafts. The mechanical interlock element is spring biased into the first notch when the sliding bolt is in the unlocked position, and is removed from the first notch when the activate line energizes the solenoid. When the sliding bolt is in the locked position, the mechanical interlock element is drawn into the second notch as long as the activate line continues to energize the solenoid. The deactivate line is not used in this embodiment.

In a third alternate embodiment, the second solenoid shaft is spring biased to prevent a key from being inserted into the lock which moves the deadbolt. When the deactivate line is energized, the second solenoid shaft is moved to allow a key to be inserted into the lock. It will be appreciated by those skilled in the art that other system configurations could be used without departing from the principal of the present invention.

It may therefore be seen that the system of the present invention requires the alarm system to be set without fail, each time the building is to be left by its inhabitants in a locked condition. The system of the present invention also provides a security system which is not capable of being deactivated by merely picking the entry lock. In accordance with the design of the present invention, the automatic setting of the security system is not initiated by merely locking the entry door, thereby allowing the entry door of a building to be locked with the inhabitants inside.

The second primary objective of the present invention, namely the provision of a security system which will be deactivated prior to entry of the building, is also achieved. The system may not be deactivated merely by unlocking the entry door, but rather is required to have an independent deactivation mechanism. It will be appreciated that the system of the present invention thereby absolutely prevents the building from being entered prior to the security system being deactivated. The system also possesses several other attributes. It is both effective and easy to use, and is of an unsophisticated design making it both economic of manufacture and highly reliable. It also eliminates all of the above problems and achieves all of the desired advantages and objectives without incurring any relative disadvantage.

DESCRIPTION OF THE DRAWINGS

These and other advantages of the present invention are best understood with reference to the drawings, in which.

DETAILED DESCRIPTION OF THE PREFERRED EMBODIMENT

Figure 1:
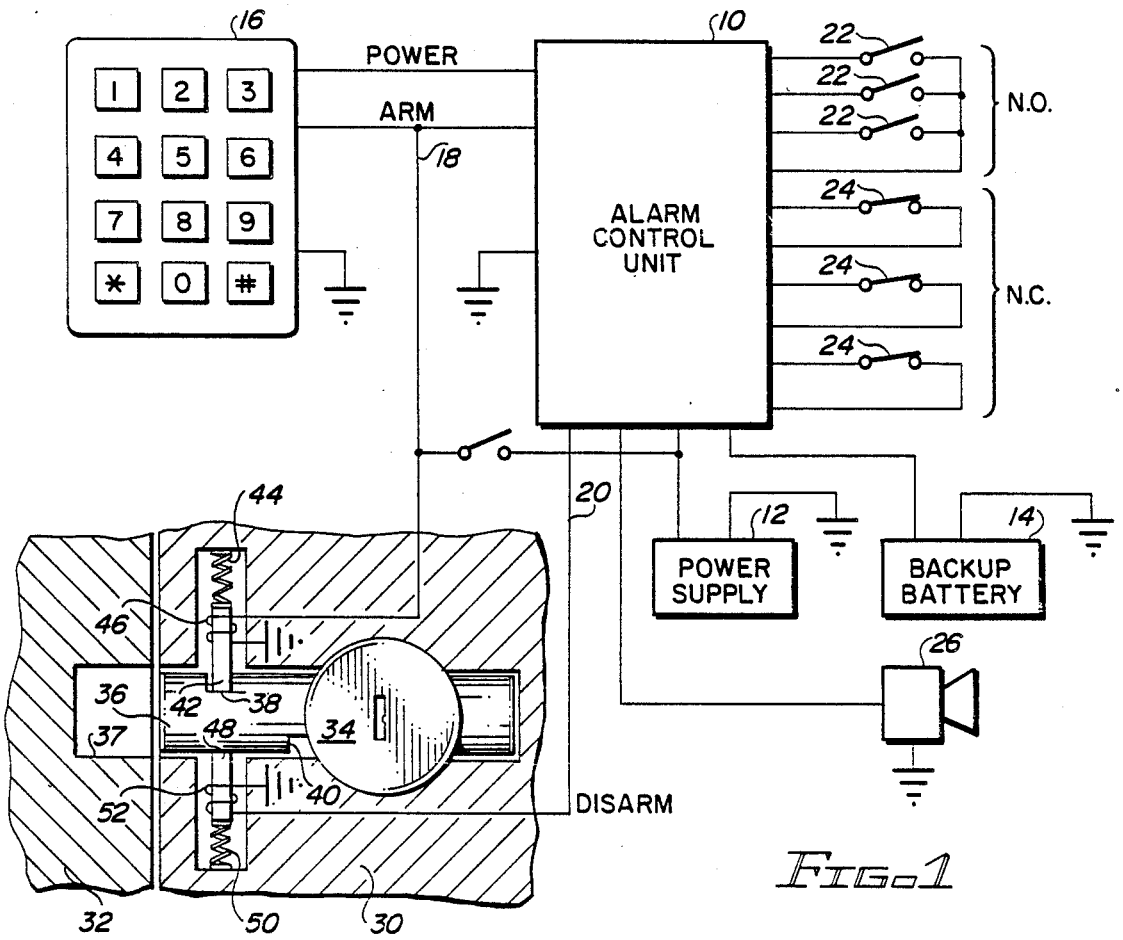
FIG. 1 is a schematic block diagram of the preferred embodiment of the present invention, with the electromechanical interlock being shown in a somewhat schematic cutaway view in the unlocked position.

The preferred embodiment of a security system embodying the present invention is illustrated in FIG. 1. An alarm control unit 10 of conventional design is the main control unit used in a typical building security system. The electrical power to operate the security system is furnished from a power supply 12, which is also of conventional design. A backup battery 14 is used to supply power to the security system on occasions when the alarm control unit 10 detects that the power supply 12 has failed, with such use of a battery as an auxiliary power supply being common in the art.

The system is armed and disarmed through the use of a numerical keypad 16, with such keypads being known in the art. When the system is disarmed, the user may press a preset numerical sequence on the numerical keypad 16 to arm the system. This is accomplished by the numerical keypad 16 supplying an ARM signal to the alarm control unit 10 when the proper numerical sequence is entered. Similarly, the numerical keypad 16 will disarm the security system when the proper numerical sequence is again entered, causing the numerical keypad 16 to cease supplying the ARM signal to the alarm control unit 10.

In the example illustrated in FIG. 1, power is supplied to the numerical keypad 16 from the alarm control unit 10, and the ARM signal is a DC voltage sent from the numerical keypad 16 to the alarm control unit 10 to cause the system to be armed. When the numeric keypad 16 is operated with the system armed to disarm the system, the numerical keypad 16 will then cease supplying the DC voltage to the alarm control unit 10, thereby causing the system to be disarmed.

It will of course be appreciated by those skilled in the art that there are other ways of utilizing the numerical keypad 16 and the alarm control unit 10 to activate and deactivate the security system. It is only necessary for the purposes of the preferred embodiment of the present invention that when the security system is armed, a DC voltage appear on an ARM control line 18 to operate the present invention. Similarly, it is necessary that a DISARM signal be generated when the security system is disarmed. Like the ARM signal, the DISARM signal is a DC voltage which appears on a DISARM control line 20 when the security system is disarmed.

It will be noted that the ARM and DISARM signals are complementary, in that when the ARM signal is present the DISARM signal is not, and vice-versa. The preferred embodiment of the present invention illustrated in FIG. 1 uses the numerical keypad 16 to generate the ARM signal on the ARM control line 18 and the alarm control unit 10 to generate the DISARM signal on the DISARM control line 20. The alarm control unit lo generates the DISARM signal on the DISARM control line 20 whenever the alarm control unit 10 detects that the ARM signal is not present on the ARM control line 18.

The security system illustrated in FIG. 1 used sensors to detect an illicit entry, which sensors are of two types. A normally open sensor 22 is used in applications such as pressure pads, and three normally open sensors 22 are shown in FIG. 1 as inputs to the alarm control unit 10. The normally open sensors 22 may be wired in parallel as shown, so that when any one of them closes (indicating an illegal entry) an alarm will be initiated by the alarm control unit 10.

The other type of sensor is the normally closed sensor 24, which is used in applications such as door and window switches. Three normally closed sensors 24 are shown in FIG. 1, and must either be wired in series or separately to the alarm control unit 10, as shown in FIG. 1. It will therefore be appreciated that when any one of the normally open sensors 22 or the normally closed sensors 24 is triggered, the alarm control unit 10 will initiate an alarm. This operation is well known in the art, and is utilized by the system of the present invention rather than forming an essential part of the present invention.

When the alarm control unit 10 initiates an alarm, it will energize a horn 26 or other audible or inaudible signal. The horn 26 may be replaced, for example, with a bell, lights, or a signal which is sent to the police or to a security agency. In addition, a combination of different signals could also be used.

The above discussion is essentially a description of a known security system, with the possible exception of the ARM and DISARM signals. The use outside of the components described to this point of the ARM and DISARM signals form the heart of the present invention. It will be realized that the ARM and DISARM signals are DC voltages with respect to ground, and as such the ARM and DISARM voltages are used to operate the interlock system, also shown in FIG. 1.

Portions of a door 30 and a door jamb 32 are shown, with the door 30 having a lock 34 which reciprocally drives a bolt 36, typically in horizontal movement. When the bolt 36 is driven by the lock 34 to the position shown in FIG. 1, in which it is retracted into the door 30 (which position is called the unlocked position), the door 30 may be freely opened or closed. When the bolt 36 is driven by the lock 34 to extend beyond the door (while the door 30 is in a closed position adjacent the door jamb 32) into a recess 37 in the door jamb 32 as shown in FIG. 2 (which position is called the locked position), the door 30 may not then be opened or closed until the bolt 36 is once again retracted into the door 30 (as shown in FIG. 1).

Figure 2:
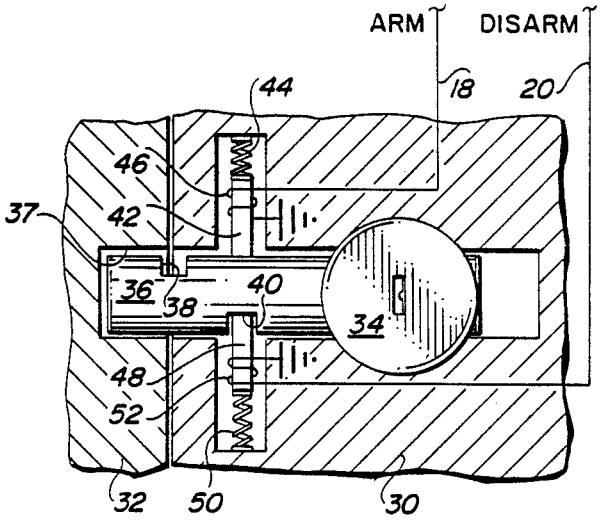
FIG. 2 is a somewhat schematic cutaway view of the electromechanical interlock of FIG. 1 in the locked position.

The bolt 36 is shown in FIGS. 1 and 2 to have two notches therein, namely a first notch 38 located on the top of the bolt 36, and a second notch 40 located on the bottom of the bolt 36. The first notch 38 is located nearer to the edge of the door 30 from which the bolt 36 extends than is the second notch 40. The notches 38 and 40 may be cylindrical apertures, or they may be simple notches in the surface of the bolt 36, as shown in the figures.

Two solenoids are also located in the door 30, together with the lock 34 and the bolt 36. A first solenoid comprises a first solenoid shaft 42 which is mounted for reciprocal movement in a vertical axis orthogonal to the bolt 36. The first solenoid shaft 42 is located above the bolt 36. When the first solenoid shaft 42 is aligned with the first notch 38 in the bolt 36 as shown in FIG. 1, the first solenoid shaft 42 will engage the first notch 38, thereby preventing movement of the bolt 36. The first solenoid shaft 42 is biased in a downward position into engagement with the first notch 38 in the bolt 36 by a first spring 44.

A first solenoid coil 46 is located around the upper portion of the first solenoid shaft 42. When the first solenoid coil 46 is energized, the first solenoid shaft 42 will be drawn upward against the first spring 44 and out of the first notch 38 in the bolt 36, thereby allowing the bolt 36 to move from the unlocked position (FIG. 1) to the locked position (FIG. 2). The first solenoid coil 46 is energized by the ARM signal on the ARM control line 18. Therefore, whenever the ARM signal is present on the ARM control line 18, the first solenoid shaft 42 will be drawn upward by the first solenoid coil 46 to allow the bolt 36 to move from the unlocked position to the locked position.

Similarly, a second solenoid comprises a second solenoid shaft 48 which is also mounted for reciprocal movement in a vertical axis orthogonal to the bolt 36. The second solenoid shaft 48 is located below the bolt 36 (and the first solenoid shaft 42). When the second solenoid shaft 48 is aligned with the second notch 40 in the bolt 36 as shown in FIG. 2, the second solenoid shaft 48 will engage the second notch 40, thereby preventing movement of the bolt 36. The second solenoid shaft 48 is biased in a upward position into engagement with the second notch 40 in the bolt 36 by a second spring 50.

A second solenoid coil 52 is located around the lower portion of the second solenoid shaft 48. When the second solenoid coil 52 is energized, the second solenoid shaft 48 will be drawn downward against the second spring 50 and out of the second notch 40 in the bolt 36, thereby allowing the bolt 36 to move from the locked position (FIG. 2) back to the unlocked position (FIG. 1). The second solenoid coil 52 is energized by the DISARM signal on the DISARM control line 20. Therefore, whenever the DISARM signal is present on the DISARM control line 20, the second solenoid shaft 48 will be drawn downward to allow the bolt 36 to move from the locked position to the unlocked position.

The operation of the system of the present invention may now be discussed with reference to FIGS. 1 and 2. When a building is inhabited, the bolt 36 will be in the unlocked position shown in FIG. 1. In that position, the first solenoid shaft 42 is engaged with the first notch 38 in the bolt 36, thereby preventing the bolt 36 from being moved to the locked position. It is thereby apparent that the lock 30 may not be used to lock the door 30 while the first solenoid shaft 42 is engaged in the first notch 38 in the bolt 36.

The system of the present invention thereby requires that before the door 30 be locked, the alarm system be armed. Accordingly, the numerical keypad 16 is used to generate the ARM signal on the ARM control line 18 to arm the system. (Note that when the ARM signal is generated, the DISARM signal, generated by the alarm control unit 10, will cease.) When the ARM signal is generated on the ARM control line 18, the first solenoid coil 46 will be energized, drawing first solenoid shaft 42 out of the first notch 38 in the bolt 36. The bolt 36 may then be moved from the unlocked position to the locked position by the lock 34.

Similarly, with the alarm system activated and the bolt 36 in the locked position shown in FIG. 2, the second solenoid shaft 48 is engaged with the second notch 40 in the bolt 36, thereby preventing the bolt 36 from being moved to the unlocked position. It is thereby apparent that the lock 30 may not be used to unlock the door 30 while the second solenoid shaft 48 is engaged in the second notch 40 in the bolt 36.

The system of the present invention thereby requires that before the door 30 be unlocked, the alarm system must be disarmed. Accordingly, the numerical keypad 16 is used to disarm the system by ceasing the generation of the ARM signal on the ARM control line 18. (Note that when the ARM signal ceases being generated, the DISARM signal will be generated by the alarm control unit 10.) When the DISARM signal is generated on the DISARM control line 20, the second solenoid coil 52 will be energized, drawing the second solenoid shaft 48 out of the second notch 40 in the bolt 36. The bolt 36 may then be moved from the locked position to the unlocked position by the lock 34.

It is also desirable to allow the bolt 36 to be locked from inside the building without requiring that the security system be activated. This is accomplished by using a spring-loaded normally open switch 54, which spring-loaded normally open switch 54 must be mounted inside the building near the lock 34 in the door 30. One side of the spring-loaded normally open switch 54 is connected to the output of the power supply, which is generally a positive DC voltage. The other side of the springloaded normally open switch 54 is connected to the ARM control line 18.

It will be appreciated that when the spring-loaded normally open switch 54 is closed, the first solenoid coil 46 will be energized, drawing the first solenoid shaft 42 out of the first notch 38, thereby allowing the bolt 36 to be moved to the closed position. The spring-loaded normally open switch 54 will only operate momentarily when the bolt 36 is to be closed from the inside of the building, and will then open, deenergizing the first solenoid coil 46. As such, when the bolt 36 is in the locked position, the DISARM signal will be present, allowing the bolt 36 to be unlocked at any time.

The spring-loaded normally open switch 54 it therefore a sort of bypass of the system. It is important to note that this bypass cannot be used from the outside of the building, since the spring-loaded normally open switch 54 is located inside the building. Therefore, in order to lock the door 30 from the outside of the building, the bypass is not available and the security system must be armed before the bolt 36 may be locked.

It is therefore apparent that the system of the present invention effectively prevents the door 30 both from being locked (from the outside) before the alarm is armed, and from being unlocked before the alarm is disarmed. A number of different modifications to the system described with reference to FIGS. 1 and 2 are readily apparent without departing from the spirit of the present invention. For example, the first and second solenoids need not be on opposite sides of the bolt 36, or above and below each other. Other possible placements are equally possible.

Figure 3:
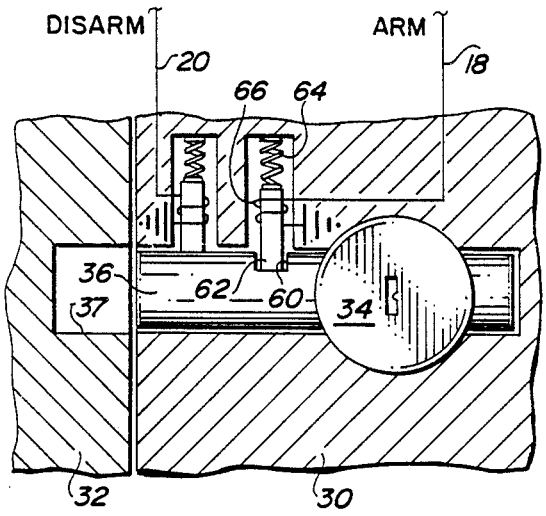
FIG. 3 is a somewhat schematic cutaway view of a first alternate embodiment of the electromechanical interlock in the unlocked position.

A first alternate embodiment is illustrated in FIG. 3. A single notch 60 is located in the top of the bolt 36. Both the first and second solenoids are located over the bolt 36, with the second solenoid being located closer to the edge of the door 30 from which the bolt 36 protrudes than is the first solenoid. The first solenoid includes a first solenoid shaft 62, a first spring 64, and a first solenoid coil 66. When the alarm system is armed, the first solenoid coil 66 is energized by the ARM signal on the ARM control line 18 to allow the bolt 36 to be moved from the unlocked position shown to a locked position (not shown).

The second solenoid includes a second solenoid shaft 68, a second spring 70, and a second solenoid coil 72. When the alarm system is disarmed, the second solenoid coil 72 is energized by the DISARM signal on the DISARM control line 20 to allow the bolt 36 to be moved from the locked position (not shown) to the unlocked position shown.

Figure 4:
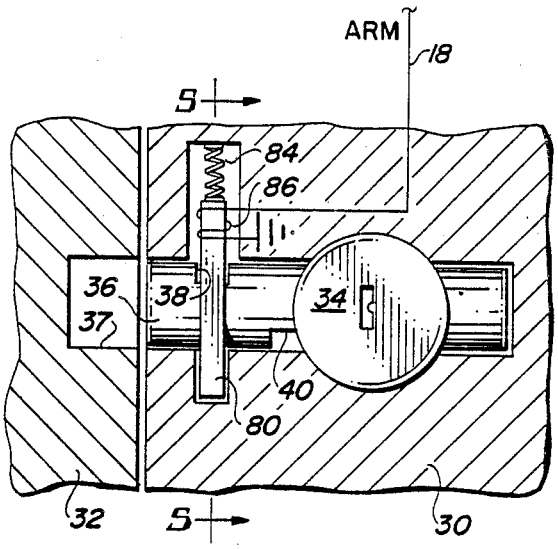
FIG. 4 is a somewhat schematic cutaway view of a second alternate embodiment of the electromechanical interlock in the unlocked position.
Figure 5:
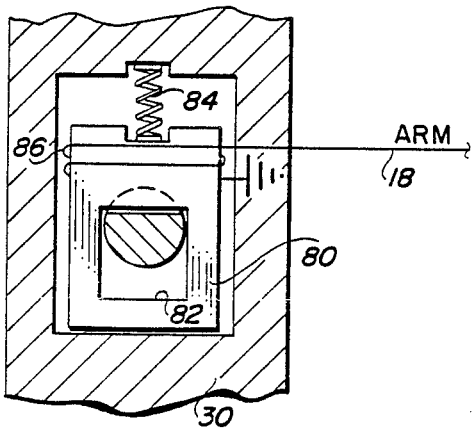
FIG. 5 is a somewhat schematic sectional view of the electromechanical interlock shown in FIG. 4.

A second alternate embodiment is illustrated in FIGS. 4 and 5. Instead of two conventional solenoids, a single solenoid of different design is used. The bolt 36 has the first notch 3 on the top and the second notch 40 on the bottom, in identical fashion to the arrangement of FIGS. 1 and 2. A solenoid core 80 having an aperture 82 therein is used, with the aperture 82 having the bolt 36 extending therethrough. When the bolt 36 is in the unlocked position shown in FIG. 4, a spring 84 biases the material of the solenoid core 80 around the top of the aperture 80 into the first notch 38, preventing the bolt 36 from moving from the unlocked position to the locked position.

A solenoid coil 86 is energized by the ARM signal on the ARM control line 18 to draw the solenoid core 80 upward against the bias of the spring 84. This allows the bolt 36 to be moved from the unlocked position shown to the locked position (not shown). Since the ARM signal will remain as long as the alarm system is armed, the solenoid core 80 will continue to be drawn upward, causing the material of the solenoid core around the bottom of the aperture 82 to engage the second notch 40. The bolt may not be moved from the locked position to the unlocked position until the ARM signal on the ARM control line 18 ceases, allowing the spring 84 to force the solenoid core downward from engagement with the second notch 40.

Figure 6:
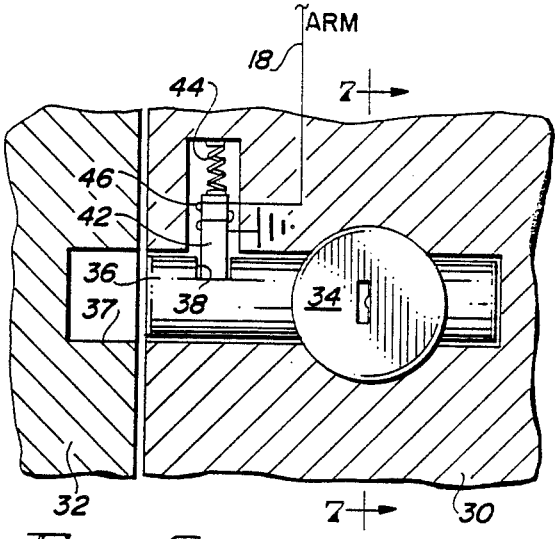
FIG. 6 is a somewhat schematic cutaway view of a third alternate embodiment of the electromechanical interlock in the unlocked position showing the first solenoid.
Figure 7:
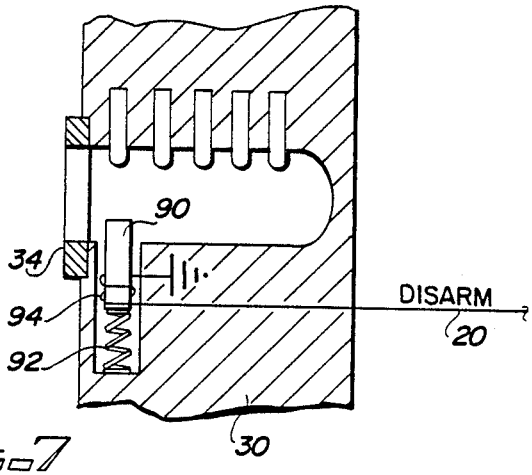
FIG. 7 is a somewhat schematic sectional view of the electromechanical interlock shown in FIG. 6, showing the second solenoid.

A third alternate embodiment is illustrated in FIGS. 6 and 7, using a first solenoid identical to the first solenoid of the preferred embodiment shown in FIGS. 1 and 2. The second solenoid is different, in that it functions to prevent a key (not shown) from being inserted into the lock 34 when the alarm is activated. Referring to FIG. 7, a second solenoid shaft 90 is biased upward in the path of a key (not shown) entering the lock 34 by a second spring 92.

The second solenoid shaft 90 is drawn downward against the second spring 92 and out of the way of a key (not shown) entering the lock 34 by a second solenoid coil 94, which is energized by the DISARM signal on the DISARM control line 20. Therefore, when the door 30 is locked, the alarm must be disarmed to generate the DISARM signal which causes the second solenoid coil 94 to draw the second solenoid shaft 90 out of the way of a key (not shown). This again prevents the door 30 from being unlocked before the alarm is disarmed. The second solenoid could be mounted in a variety of different ways to accomplish the objective of blocking the path of a key (not shown) into the lock 34.

It will be appreciated from the above description of the present invention that it positively requires the alarm system to be set each time the building is to be left by its inhabitants in a locked condition. In accordance with the design of the present invention, the automatic setting of the security system is not initiated by merely locking the entry door, thereby allowing the entry door of a building to be locked with the inhabitants inside.

The present invention also achieves the second primary objective of requiring the security system to be deactivated prior to entry of the building. The system of the present invention is not capable of being operated or deactivated by merely picking the entry lock. The system therefore has a fully independent deactivation mechanism. It absolutely prevents the building from being entered prior to the security system being deactivated.

The system of the present invention is both effective and easy to use, and is of a mechanically and electrically unsophisticated design making it both economic to manufacture and highly reliable. It eliminates all of the above problems discussed above, and achieves all of the desired advantages and objectives without incurring any relative disadvantage. As such it represents a highly desirable improvement in the technology of building security systems.

Although an exemplary embodiment of the present invention has been shown and described, it will be apparent to those having ordinary skill in the art that a number of changes, modifications, or alterations to the invention as described herein may be made, none of which depart from the spirit of the present invention. All such changes, modifications, and alterations should therefore be seen as within the scope of the present invention.

What is claimed is:

1. A security system for use in a building in conjunction with an entry door in the building comprising:

a main on/off switch for selectively providing an arming signal to arm the security system, the security system being armed whenever said main on/off switch is providing said arming signal and disarmed whenever said main on/off switch is not providing said arming signal;

an alarm control unit;

sensor means for detecting the occurrence of an illicit entry, said sensor means providing a sensor signal indicative of an illicit entry to said alarm control unit;

said main on/off switch and said sensor means being connected to said alarm control unit, said alarm control unit being armed when said arming signal is provided from said main on/off switch and disarmed when said arming signal is not provided from said main on/off switch, said alarm control unit generating an alarm signal when it is armed and said sensor signal is provided from said sensor means;

power supply means for supplying power to said alarm control unit;

lock means for selectively locking and unlocking said entry door;

first interlock means for preventing said lock means from locking said entry door when said alarm control unit is disarmed; and second interlock means for preventing said lock means from unlocking said entry door when said alarm control unit is armed.

2. A security system as defined in claim 1, wherein said main on/off switch comprises:

a numerical keypad, said numerical keypad generating said arming signal when a preselected numerical sequence is entered, said numerical keypad then ceasing the generation of said arming signal when said preselected numerical sequence is entered again.

3. A security system as defined in claim 1, wherein said main on/off switch comprises:

a key-operated switch having a first position and a second position, said key-operated switch generating said arming signal when said key operated switch is in said first position, said key-operated switch ceasing the generation of said arming signal when said key operated switch is in said second position.

4. A security system as defined in claim 1, wherein said sensor means comprises:

a plurality of normally open sensors, said normally open sensors closing to indicate an illicit entry, said sensor signal being generated when any one of said normally open sensors closes.

5. A security system as defined in claim 1, wherein said sensor means comprises:

a plurality of normally closed sensors, said normally closed sensors opening to indicate an illicit entry, said sensor signal being generated when any one of said normally closed sensors opens.

6. A security system as defined in claim 1, wherein said power supply means comprises:

a power supply for supplying electrical power to operate the security system to said alarm control unit; and a backup battery for supplying electrical power to operate the security system on occasions when said alarm control unit detects that said power supply has ceased to supply electrical power to operate the security system.

7. A security system as defined in claim 1, wherein said lock means comprises:

a key-operated lock; and a bolt driven by said key-operated lock in reciprocating movement between a first position in which it is retracted into the door, which position is called the unlocked position, and a second position in which it extends beyond the door, which position is called the locked position.

8. A security system as defined in claim 7, wherein said alarm control unit generates a disarming signal whenever said arming signal is not provided, said first interlock means being operated by said arming signal and said second interlock means being operated by said disarming signal.

9. A security system as defined in claim 8, wherein said first interlock means comprises:

a first notch in said bolt;

a first solenoid shaft mounted for reciprocating motion orthogonal to said bolt;

a first spring for biasing said first solenoid shaft toward said bolt, said first solenoid shaft fitting into said first notch in said bolt when said bolt is located in said unlocked position, thereby preventing said bolt from being moved from said unlocked position to said locked position; and a first solenoid coil for drawing said first solenoid shaft away from said bolt and out of said first notch in said bolt when said first solenoid coil is energized, said first solenoid coil being energized when said alarm control unit is armed to draw said first solenoid shaft out of said first notch in said bolt after said alarm control unit is armed, thereby allowing said bolt to be moved from said unlocked position to said locked position.

10. A security system as defined in claim 9, wherein said first solenoid coil is energized by said arming signal.

11. A security system as defined in claim 9, wherein said second interlock means comprises:

a second notch in said bolt;

a second solenoid shaft mounted for reciprocating motion orthogonal to said bolt;

a second spring for biasing said second solenoid shaft toward said bolt, said second solenoid shaft fitting into said second notch in said bolt when said bolt is located in said locked position, thereby preventing said bolt from being moved from said locked position to said unlocked position; and a second solenoid coil for drawing said second solenoid shaft away from said bolt and out of said second notch in said bolt when said second solenoid coil is energized, said second solenoid coil being energized when said alarm control unit is disarmed to draw said second solenoid shaft out of said second notch in said bolt after said alarm control unit is disarmed, thereby allowing said bolt to be moved from said locked position to said unlocked position.

12. A security system as defined in claim 11, wherein said second solenoid coil is energized by said disarming signal.

13. A security system as defined in claim 9, wherein said second interlock means comprises:

a second solenoid shaft mounted for reciprocating motion orthogonal to said bolt;

a second spring for biasing said second solenoid shaft toward said bolt, said second solenoid shaft fitting into said first notch in said bolt when said bolt is located in said locked position, thereby preventing said bolt from being moved from said locked position to said unlocked position; and a second solenoid coil for drawing said second solenoid shaft away from said bolt and out of said first notch in said bolt when said second solenoid coil is energized, said second solenoid coil being energized when said alarm control unit is disarmed to draw said second solenoid shaft out of said first notch in said bolt after said alarm control unit is disarmed, thereby allowing said bolt to be moved from said locked position to said unlocked position.

14. A security system as defined in claim 9, additionally comprising:

a second solenoid shaft mounted for reciprocating motion between a first position which will prevent a key from being inserted into said lock and a second position which will allow a key to be inserted into said lock;

a second spring for biasing said second solenoid shaft in said first position, thereby preventing a key from being inserted into said lock; and a second solenoid coil for drawing said second solenoid shaft from said first position to said second position when said second solenoid coil is energized, said second solenoid coil being energized when said alarm control unit is disarmed to draw said second solenoid shaft from said first position to said second position after said alarm control unit is disarmed, thereby allowing a key to be inserted into said lock.

15. A security system as defined in claim 8, additionally comprising:

bypass means for allowing said bolt to be moved from said unlocked position to said locked position from a location inside the building without requiring the security system to be activated.

16. A security system as defined in claim 15, wherein said bypass means comprises:

switch means for temporarily generating said arming signal to allow said bolt to be moved from said unlocked position to said locked position, said switch means being located inside the building.

17. A security system as defined in claim 7, wherein said first and second interlock means comprise:

a first notch in said bolt;

a second notch in said bolt on the side of said bolt opposite said first notch;

a solenoid core mounted for reciprocating motion orthogonal to said bolt, said solenoid core having an aperture therein, said bolt extending through said aperture;

a spring for biasing the material of said solenoid core around the top of said aperture into said first notch in said bolt when said bolt is located in said unlocked position, thereby preventing said bolt from being moved from said unlocked position to said locked position; and a solenoid coil for drawing said solenoid core out of said first notch against the bias of said spring in said bolt when said solenoid coil is energized, said solenoid coil being energized when said alarm control unit is armed to draw said solenoid out of said first notch in said bolt after said alarm control unit is armed, thereby allowing said bolt to be moved from said unlocked position to said locked position, the material of said solenoid core around the bottom of said aperture being drawn upward into said second notch in said bolt when said bolt is located in said locked position, thereby preventing said bolt from being moved from said locked position to said unlocked position.

18. A security system for use in a building in conjunction with an entry door in the building, comprising:

a numerical keypad for selectively providing an arming signal to arm the security system, the security system being armed whenever said numerical keypad is providing said arming signal and disarmed whenever said numerical keypad is not providing said arming signal, said numerical keypad generating said arming signal when a preselected numerical sequence is entered, said numerical keypad then ceasing the generation of said arming signal when said preselected numerical sequence is entered again;

sensor means for detecting the occurrence of an illicit entry, said sensor means providing a sensor signal indicative of an illicit entry to said alarm control unit;

an alarm control unit, said numerical keypad and said sensor means being connected to said alarm control unit, said alarm control unit being armed when said arming signal is provided from said numerical keypad and disarmed when said arming signal is not provided from said numerical keypad, said alarm control unit generating an alarm signal when it is armed and said sensor signal is provided from said sensor means, said alarm control unit generating a disarming signal whenever said arming signal is not provided;

power supply means for supplying power to said alarm control unit;

a key-operated lock; and a bolt driven by said key-operated lock in reciprocating movement between a first position in which it is retracted into the door, which position is called the unlocked position, and a second position in which it extends beyond the door, which position is called the locked position, said bolt and keyoperated lock thereby selectively locking and unlocking said entry door;

first interlock means for preventing said bolt from moving from said unlocked position to said locked position when said alarm control unit is disarmed; and second interlock means for preventing said bolt from moving from said locked position to said unlocked position when said alarm control unit is armed.

19. A security system for use in a building in conjunction with an entry door in the building, comprising:

an alarm control unit, said alarm control unit being selectively armed or disarmed, said alarm control unit generating an alarm signal when it is armed and an illicit entry is detected;

lock means for selectively locking and unlocking said entry door;

first interlock means for preventing said lock means from locking said entry door when said alarm control unit is disarmed;

second interlock means for preventing said lock means from unlocking said entry door when said alarm control unit is armed; and master switch means interconnecting said alarm control unit, first interlock means and second interlock means;

whereby said master switch means operates to arm said alarm control circuit and deactivate said first interlock means to enable locking of said entry door; and whereby said master switch means operates to disarm said control circuit and deactivate said second interlock means to enable unlocking of said entry door.

20. A method of operating a security system for use in a building in conjunction with an entry door in the building, comprising:

selectively providing an arming signal to arm the security system from a main on/off switch, the security system being armed whenever said main on/off switch is providing said arming signal and disarmed whenever said main on/off switch is not providing said arming signal;

detecting the occurrence of an illicit entry with sensor means, said sensor means providing a sensor signal indicative of an illicit entry to said alarm control unit;

connecting said main on/off switch and said sensor means to an alarm control unit, said alarm control unit being armed when said arming signal is provided from said main on/off switch and disarmed when said arming signal is not provided from said main on/off switch;

generating an alarm signal with said alarm control unit when said alarm control unit is armed and said sensor signal is provided from said sensor means;

selectively locking and unlocking said entry door with lock means;

preventing said lock means from locking said entry door when said alarm control unit is disarmed with first interlock means; and preventing said lock means from unlocking said entry door when said alarm control unit is armed with second interlock means.

21. A security system for use in a building in conjunction with an entry door in the building, comprising:

(a) an alarm system;

(b) means for activating said alarm system, (c) means for deactivating said alarm system, (d) an entry door;

(e) lock means for selectively locking and unlocking said entry door;

(f) first interlock means for preventing said lock means from locking said entry door;

(g) independent master switch means; and
(h) circuit means interconnecting said master switch means, interlock means, lock means, means for activating said alarm system, means for deactivating said alarm system, and said alarm system,
(i) whereby said master switch means activates said means for activating said alarm system and deactivates said first interlock means to enable locking of said entry door.

22. The security system of claim 21, including second interlock means for preventing said lock means from unlocking said entry door, wherein said master switch means activates said means for deactivating said alarm system and deactivates said second interlock means to enable unlocking of said entry door.

23. A security system for use in a building in conjunction with an entry door in the building, comprising:
(a) an alarm system;
(b) means for activating said alarm system,
(c) means for deactivating said alarm system,
(d) an entry door,
(e) lock means for selectively locking and unlocking said entry door;
(f) second interlock means for preventing said lock means from unlocking said entry door,
(g) independent master switch means, and
(h) circuit means interconnecting said master switch means, interlock means, lock means, means for activating said alarm system, means for deactivating said alarm system, and said alarm system,
(i) whereby said master switch means activates said means for deactivating said alarm system and deactivates said second interlock means to enable unlocking of said entry door.

* * * * *